US005628853A

United States Patent [19]

Edwards

[11] Patent Number: 5,628,853

[45] Date of Patent: May 13, 1997

[54] METHOD FOR MANUFACTURING FOIL LAMINATED TABLETOPS

[75] Inventor: John R. Edwards, Nobleton, Canada

[73] Assignee: Hollanding Inc., Newmarket, Canada

[21] Appl. No.: 492,190

[22] Filed: Jun. 19, 1995

Related U.S. Application Data

[62] Division of Ser. No. 234,118, Apr. 28, 1994, Pat. No. 5,455,095.

[30] Foreign Application Priority Data

Mar. 23, 1994 [CA] Canada ..... 2119925

[51] Int. Cl.[6] ..... B32B 31/00

[52] U.S. Cl. ..... 156/212; 156/216; 156/228; 156/267; 156/293

[58] Field of Search ..... 156/196, 212, 156/216, 228, 267, 293

[56] References Cited

U.S. PATENT DOCUMENTS

| | | | |
|---|---|---|---|
| 4,643,787 | 2/1987 | Goodman | 156/196 |
| 4,751,125 | 6/1988 | Ofterdinger | 428/68 |
| 4,814,220 | 3/1989 | Brathwaite | 428/119 |
| 5,322,174 | 6/1994 | Wolters | 428/68 |

OTHER PUBLICATIONS

C.I. Kasei Co., Ltd., "Bonlex Sample List", Part of document.

Friz Maschinenbau GmbH, "Profile Wrapping Machines", entire document.

Friz Maschinenbau GmbH, "Membrane Form Presses MFP", entire document.

Friz Maschinenbau GmbH, "Membrane Form Preses", entire document.

Friz Maschinenbau GmbH, "Purmelt PUR–Rakelauftragsgerat", entire document.

Friz Maschinenbau GmbH, "Masterform–Die Neue Generation Membranpressen", entire document.

*Primary Examiner*—James Sells

*Attorney, Agent, or Firm*—Riches, McKenzie & Herbert

[57] ABSTRACT

This invention relates generally to foil laminated tabletops and to methods for their manufacture. Tabletops according to the present invention can be laminated over their entire upper and side surfaces with a continuous sheet of thin foil, the foil typically comprising a plastic material. The foil layer ends at an angular lower edge where the side surface intersects the lower surface of the tabletop. By providing an angle preferably greater than about 120° about the lower edge, the lower edge of the tabletop preferably does not feel sharp and the edge of the foil is at least partially hidden from view. The present invention also provides foil laminated tabletops having an upper surface provided with functional retaining recesses for retaining items on the tabletop.

22 Claims, 4 Drawing Sheets

METHOD FOR MANUFACTURING FOIL LAMINATED TABLETOPS

This application is a division of application Ser. No. 08/234,118 filed Apr. 28, 1994, U.S. Pat. No. 5,455,095.

SCOPE OF THE INVENTION

This invention relates generally to foil laminated tabletops, methods for their manufacture, and to foil laminated tabletops having upper surfaces provided with functional recesses.

BACKGROUND OF THE INVENTION

Foil lamination is gaining popularity as a method for applying decorative surfaces to a variety of substrates, particularly substantially flat, contoured panels used as kitchen cabinet doors.

Foils used in foil lamination typically comprise thin sheets of plastic which are highly flexible and able to stretch when heated. Commercially available foils typically comprise thin sheets of plastic material, such as polyethylene, polypropylene, polyvinyl chloride (PVC) and polyester from about 0.2 to about 4.0 mm in thickness, more preferably about 0.3 mm to about 1.0 mm., with one side of the foil being provided with a decorative finish. Plastic foils are available in a variety of finishes, for example wood grain, stones such as marble, suede, etc. These foils are suitable for both indoor and outdoor use, being weatherproof, virtually maintenance free and very easy to clean.

Suitable films are available from C. I. Kasei Co., Ltd. under the trademark BONLEX. Bonlex material is a thermoplastic, thermo-formable PVC material specially designed for membrane press applications. It consists of a combination of polyvinyl chloride and other synthetic materials.

The foil's flexible properties allow it to conform to the surface contours of a substrate and provide a continuous layer of material over the substrate, the foil "stretching into" depressions such as grooves, channels, holes etc. in the surface. These depressions are generally of a decorative nature, for example grooves cut into the face of a cabinet door.

Foil lamination is typically accomplished by adhering a thin plastic foil onto a substrate under pressure in a membrane form press. The substrate onto which the foil is adhered typically comprises a rigid, inexpensive material which can be easily cut, routed, milled or sanded into a variety of shapes and contours, for example fibreboard. One preferred substrate for foil lamination is medium density fibreboard.

The foil is adhered to the substrate by a thin layer of glue applied between the foil and the substrate. The glue may be applied to one or both of the substrate and the foil. Typically, the back of the foil is provided with an adhesive primer which improves adhesion of the foil to the substrate. The glue is typically either water or solvent based and may be heat activated. Heat activated glues require the application of heat in the membrane form press.

The membrane form press typically comprises a pressure chamber into which the foil-covered substrate is loaded, with the lower surface, i.e. the surface of the substrate which is not to be laminated, typically lying flat on a platform in the pressure chamber.

Pressure is generated in the pressure chamber by, for example, compressed air. The pressure forces the foil into intimate contact with the substrate such that a strong bond is formed between the foil and the substrate and the foil closely follows the contours of the substrate.

Thus, in one simple operation in a membrane form press, a substrate may be quickly laminated with a continuous sheet of foil. Conventional membrane presses are known to laminate foil onto the upper surface and the sides of a flat panel. Suitable membrane form presses are manufactured by Friz Maschinenbau GmbH of Weinsberg, Germany which provide controlled glue applications, even heating of the foil, hydraulic and pneumatic presses and optional bottom vacuum systems.

Typically, the foil sheet applied to the substrate has a larger surface area than the surface area of the substrate to be covered. Also, the foil tends to stretch during the pressing process. This results in excess foil extending from the laminated surface after the lamination process. This excess foil must be trimmed from the edges of the substrate, the trimming frequently being done manually with a cutting instrument such as a knife.

For many applications, lamination with foil is preferred over lamination with other conventional high pressure laminates, such as Arborite™ sheeting. Arborite sheeting is a moderately flexible material made from decorative papers laminated at high pressure with thermosetting melamine resin, which is typically applied to a substrate by glue, and is commonly used as a surface for countertops and tabletops.

Conventional laminates such as Arborite sheeting have limited flexibility and are only practically able to bend in one dimension around smoothly rounded corners having a relatively large radius of curvature. This limits the applicability of conventional laminates.

In a surface such as a tabletop having both an upper and side surface, it is typically not practically possible to laminate the entire upper and side surfaces with a single sheet of Arborite sheeting or like materials due to their ability to bend in only one dimension. In a tabletop having a rectangular upper surface and a side surface comprising four sides, for example, it is typical to laminate the upper surface and two of the sides with a first continuous sheet of conventional laminate and to laminate the remaining two sides with separate pieces of laminate.

The joints formed between adjoining sheets of laminate are both aesthetically unpleasing and difficult to clean. The collection of dirt in such joints is of concern from a health standpoint, particularly in surfaces which should be sanitized, such as tabletops and countertops.

Further, the separate application of numerous pieces of laminate to a substrate, including time spent cutting each piece of laminate to the correct size and clamping it to the substrate, results in a substantial time cost. Some substrates have such intricate contours formed in their surfaces that it is not only inconvenient, but impossible, to laminate such substrates with a conventional laminate. For example, it is usually difficult or impossible to laminate the surface of a substrate having recesses with a continuous sheet of conventional laminates such as Arborite sheeting. These recesses typically cannot be laminated with one piece of conventional sheeting since they require bending of the laminate in more than one dimension. Also, the radii of the curves in these recesses are frequently too small to be closely followed by conventional sheeting with limited flexibility.

Lamination with highly flexible foils overcomes many of the problems encountered with conventional laminates, since foils are not limited to bending in one dimension and can stretch about relatively sharp corners and rounded corners having a relatively small radius of curvature. Further, foils are capable of very closely following the contours of a substrate, even very intricate decorative or functional recesses carved into a surface. Thus, with foil lamination it is possible to provide a continuous sheet of material over the surface of a substrate, even substrates with relatively intricate recesses. Lamination with a continuous sheet of flexible foil results in a surface which is both more aesthetically pleasing and easier to clean than a conventionally laminated surface having joints.

Cabinet doors and tabletops are known which are foil laminated with a continuous sheet of material on both their upper and side surfaces. Such cabinet doors and tabletops have an upper surface and a side surface extending downward from the upper surface about the perimeter of the upper surface, with the side surface and lower surface meeting at a right angled lower edge and with the foil applied abruptly terminating at this lower edge where the side surface and the lower surface intersect. While the abrupt termination of the foil at the lower edge may be acceptable in some applications where the lower edge of the laminated substrate is not normally noticeable, such as in cabinet doors, abrupt termination at the lower edge of a tabletop has been appreciated by the present inventor as not preferred.

SUMMARY OF THE INVENTION

To at least partially overcome many of the disadvantages of the prior art, the present invention provides in one aspect, foil laminated countertops wherein a foil covered side surface intersects with an uncovered lower surface at a non-blended lower edge forming an included angle greater than 90° and preferably greater than about 120°.

The inventor has surprisingly found that an angular lower edge, wherein the side surface and lower surface preferably intersect at an angle greater than about 120°, provides sufficient wrap around to place the edge of the foil at least partially out of sight, thus making the tabletop more acceptable to consumers. The angular lower edge also acts as a reference point along which the excess foil can be trimmed neatly after the pressing operation, thus providing a smooth, continuous edge where the foil terminates along the lower edge of the tabletop.

In this regard, the invention provides in a foil laminated tabletop in which a foil is laminated to a substrate over a top surface to extend down over a side surface and to terminate at a lower edge at the intersection of the side surface with a bottom surface. The lower edge in cross-section represents a non-blended transition between a flat planar portion of the bottom surface bordering on the lower edge and a portion of the side wall adjacent the lower edge and ending at the edge. An included angle measured about the lower edge from the flat planar portion of the bottom surface to a tangent to the side surface at the lower edge is selected to be between about 120° and 170°. The non-blended transition and the extent of the included angle give the appearance that the foil extends under the tabletop and out of view. In manufacture of the tabletop by foil lamination processes, the flat planar portion of the bottom surface about the lower edge provides a guide surface for a flat cutting knife whereby such a knife may in engagement with the bottom surface be guided to cut excess foil which extends from the lower edge, resulting in a straight, uniform cut line in the plane of the flat planar portion of the bottom surface. The tabletop may have many other corners and edges where the foil covers the substrate which may be blended or non-blended transitions between intersecting surfaces, however the lower edge where the foil ends is to be a non-blended transition. While the invention is described with particular relevance to tabletops, the use of a non-blended transition where the foil ends is advantageous for other foil laminated products including kitchen cabinet doors.

The inventor has in another aspect of the present invention further appreciated that tabletops having functional retaining recesses may conveniently be produced by foil lamination. Since the foil closely follows the contours of the tabletop, including the recesses in the upper surface of the tabletop, a smooth, continuous surface, free of joints, is provided. This produces a tabletop which is both aesthetically pleasing and easy to clean, as there are no joints in the tabletop to collect dirt.

Such functional retaining recesses include: grooves for retaining writing instruments such as pens and pencils, a spill retaining groove for retaining spilled liquids on a tabletop, a cupholder, a recess which retains a napkin dispenser or condiment holder, and a hole through the tabletop substantially centered in the upper surface to retain a pole, which may be provided with an umbrella or a sunshade.

An object of the present invention is to at least partially overcome many of the difficulties encountered in producing foil laminated tabletops with a continuous sheet of foil adhered to the upper surface and side surface of the tabletop.

Another object of the present invention is to provide a foil laminated tabletop which is aesthetically pleasing and acceptable to consumers.

Another object of the present invention is to provide a foil laminated tabletop wherein the lower edge at the intersection of the side surface and lower surface appears at least partially hidden from view.

Another object of the present invention is to provide a foil laminated tabletop having an angular lower edge which does not feel as sharp as a 90° edge.

Another object of the present invention is to provide a foil laminated tabletop from which excess foil can neatly and easily be trimmed and which is acceptable to consumers.

Another object of the present invention is to provide a foil laminated tabletop having functional retaining recesses in its upper surface.

Another object of the present invention is to provide a method for manufacturing a foil laminated tabletop.

In one aspect, the present invention provides a foil laminated tabletop, comprising: a substrate comprising an upper surface, a lower surface and a side surface; the side surface extending downwardly from the upper surface to the lower surface to join the upper and lower surfaces; the lower surface lying in a flat lower plane, the upper surface being substantially parallel to the lower plane; the side surface and the lower surface intersecting at a lower edge; an included angle measured about the lower edge through the substrate from the lower plane to a tangent to the side surface at the lower edge being at least about 120 degrees; a thin plastic foil extending as a continuous sheet over the entirety of the upper surface and down over the side surface to the lower edge; the foil being adhered to the upper surface and the side surface to closely adopt profiles thereof, the foil having an edge adjacent the lower edge lying substantially in the lower plane.

In another aspect, the present invention provides a foil laminated tabletop, comprising: a substrate comprising an upper surface, a lower surface and a side surface; the side surface extending downwardly from the upper surface to the lower surface to join the upper and lower surfaces; the side surface and the lower surface intersecting at a lower edge; the upper surface substantially lying in a flat upper plane; the lower surface having a border portion extending inwardly from the lower edge; in a cross-sectional reference plane through any point along the lower edge normal to the side surface at such point and normal to the upper plane, the border portion being linear and disposed at an elevation angle equal to or greater than 0° and less than about 20° relative to the upper plane; an included angle measured about the lower edge through the substrate in said reference plane at any point along the lower edge from the border portion to a tangent to the side surface at the lower edge being at least about 120°; a thin plastic foil extending as a continuous sheet over the entirety of the upper surface and down over the side surface to the lower edge; the foil being adhered to the upper surface and the side surface to closely adopt profiles thereof; the foil having an edge adjacent the lower edge lying substantially in the same plane as that described by the border portion.

In yet another aspect, the present invention provides a method for manufacturing a foil laminated tabletop, comprising: forming a tabletop from a solid substrate, said substrate comprising an upper surface, a flat planar lower surface and a side surface; the side surface extending downwardly from the upper surface to the lower surface to join the upper and lower surfaces; the lower surface lying in a flat plane, the upper surface being substantially parallel to the plane; the side surface and the lower surface intersecting at a lower edge; an included angle measured about the lower edge through the substrate from the plane to a tangent to the side surface at the lower edge being at least about 120 degrees; laying a sheet of plastic foil over the upper surface of the substrate with a thin layer of glue being provided between the foil and the substrate, the area of the foil being greater than the combined area of the upper surface and the side surface of the substrate; loading the substrate covered with the plastic foil into a membrane form press, the press having a pressure chamber in which pressure is applied to the substrate and the plastic foil; applying heat and pressure to the substrate and the foil in the pressure chamber of the membrane form press so that the plastic foil becomes adhered to the substrate and extends as a continuous sheet over the entirety of the upper surface and down over the side surface to the lower edge, the foil being adhered to the upper surface and the side surface to closely adopt profiles thereof; removing the foil laminated tabletop from the membrane form press; and trimming excess plastic foil from the tabletop with a cutting instrument having a cutting blade, by cutting through the foil along the lower edge, the blade of the cutting instrument being positioned substantially parallel to the plane while cutting the foil.

In yet another aspect, the present invention provides a foil laminated tabletop, comprising: a substrate including an upper surface with an outer perimeter, a lower surface with an outer perimeter, and a side surface extending downwardly from the outer perimeter of the upper surface to the outer perimeter of the lower surface; the upper surface substantially lying in a flat plane but including a functional retaining recess wherein the upper surface includes a recessed surface situated below the plane; the side surface and the lower surface intersecting at a lower edge; a thin plastic foil extending as a continuous sheet over the entirety of the upper surface and down over the side surface at least to the lower edge, the plastic foil being adhered to the upper surface and side surface to closely adopt profiles thereof; the plastic foil bonded to the substrate by a pressure adhesion process using a membrane form press; the plastic foil comprising a thin sheet of plastic material, the plastic material being selected from the group comprising polyethylene, polypropylene, polyvinyl chloride and polyester; the sheet being from 0.2 to 1.0 mm in thickness.

In another aspect, the present invention provides a foil laminated tabletop, comprising: a substrate including an upper surface with an outer perimeter, a lower surface with an outer perimeter, and a side surface extending downwardly from the outer perimeter of the upper surface to the outer perimeter of the lower surface; the upper surface substantially lying in a flat plane but including a functional retaining recess wherein the upper surface includes a recessed surface situated below the plane; the side surface and the lower surface intersecting at a lower edge; a thin plastic foil extending as a continuous sheet over the entirety of the upper surface and down over the side surface at least to the lower edge, the plastic foil being adhered to the upper surface and side surface to closely adopt profiles thereof.

In yet another aspect, the present invention provides a method for manufacturing a foil laminated tabletop, comprising: forming a tabletop from a solid substrate, said substrate comprising an upper surface, a lower surface and a side surface; the side surface extending downwardly from the upper surface to the lower surface to join the upper and lower surfaces; the lower surface lying in a flat lower plane, the upper surface being substantially parallel to the lower plane; the side surface and the lower surface intersecting at an angular lower edge; an included angle measured about the lower edge through the substrate from the lower plane to a tangent to the side surface at the lower edge being at least about 120 degrees; laying a sheet of thin plastic foil over the upper surface of the tabletop, the plastic foil having an inner surface and an outer surface opposite the inner surface; loading the substrate covered with the plastic foil into a membrane form press, the press having a pressure chamber in which pressure is applied to the substrate and the plastic foil; applying pressure to the substrate and the foil in the pressure chamber of the membrane form press, the inner surface of the plastic foil becoming directly adhered to the substrate, the plastic foil extending as a smooth, free of joints, continuous sheet over the entirety of the upper surface and down over the side surface to the lower edge to closely adopt profiles of the upper and side surfaces with excess foil extending from the side surface of the tabletop at the lower edge and said excess foil not adhered to the substrate; removing the foil laminated tabletop from the membrane form press; and trimming the excess plastic foil from the tabletop along the lower edge to form an end surface of the foil joining the inner and outer surfaces of the foil and lying substantially in the lower plane.

In yet another aspect, the present invention provides a method for manufacturing a foil laminated tabletop, comprising: forming a tabletop from a solid substrate, said substrate comprising an upper surface, a lower surface and a side surface; the side surface extending downwardly from the upper surface to the lower surface to join the upper and lower surfaces; the side surface and the lower surface intersecting at an angular lower edge; the upper surface lying in a flat upper plane; the lower surface having a border portion extending inwardly from the lower edge; in a cross-sectional reference plane normal to the side surface and normal to the upper plane, the border portion being linear and disposed at an elevation angle equal to or greater than 0° and less than about 20° relative to the upper plane; an included angle measured about the lower edge through the substrate in said reference plane at any point along the lower edge from the border portion to a tangent to the side surface at the lower edge being at least about 120 degrees; laying a sheet of thin plastic foil over the upper surface of the substrate, the plastic foil having an inner surface and an outer surface opposite the inner surface; loading the substrate covered with the plastic foil into a membrane form press, the press having a pressure chamber in which pressure is applied to the substrate and the plastic foil; applying pressure to the substrate and the foil in the pressure chamber of the membrane form press, the inner surface of the plastic foil becoming directly adhered to the substrate, the plastic foil extending as a smooth, free of joints, continuous sheet over the entirety of the upper surface and down over the side surface to the lower edge to closely adopt profiles of the upper and side surfaces with excess foil extending from the side surface of the tabletop at the lower edge and said excess foil not adhered to the substrate; removing the foil laminated tabletop from the membrane form press; and trimming the excess plastic foil from the tabletop along the lower edge to form an end surface of the foil joining the inner and outer surfaces of the foil and being substantially collinear with the border portion in the reference plane.

BRIEF DESCRIPTION OF THE DRAWINGS

Further aspects and advantages of the present invention will become apparent from the following description, taken together with the accompanying drawings, in which.

DESCRIPTION OF THE PREFERRED EMBODIMENTS

Figure 1:
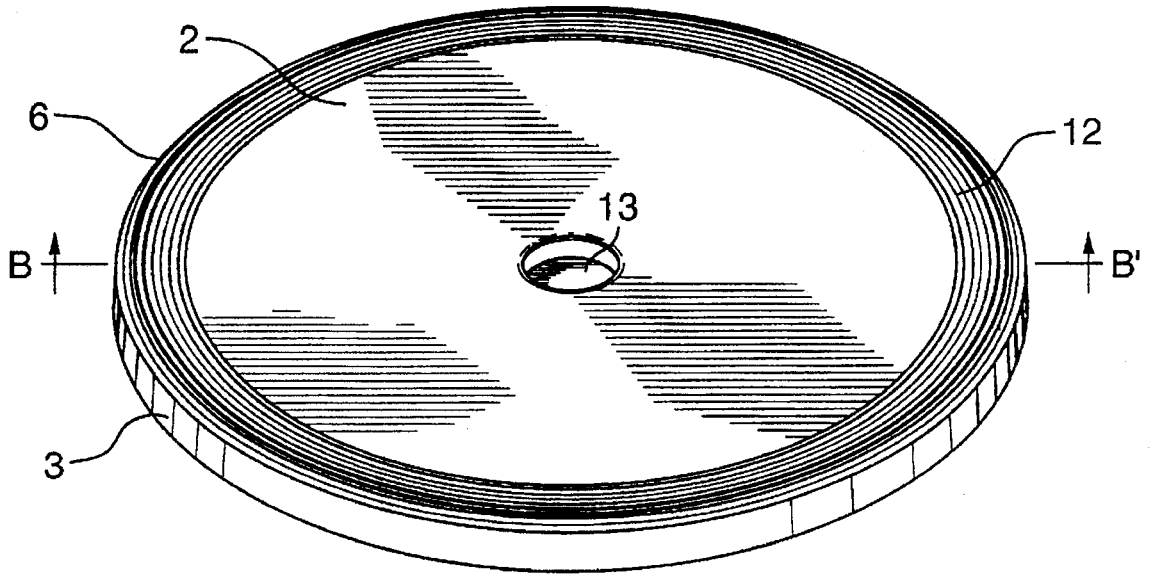
FIG. 1 is a top perspective view of a circular foil laminated tabletop according to a first embodiment the present invention.
Figure 2:
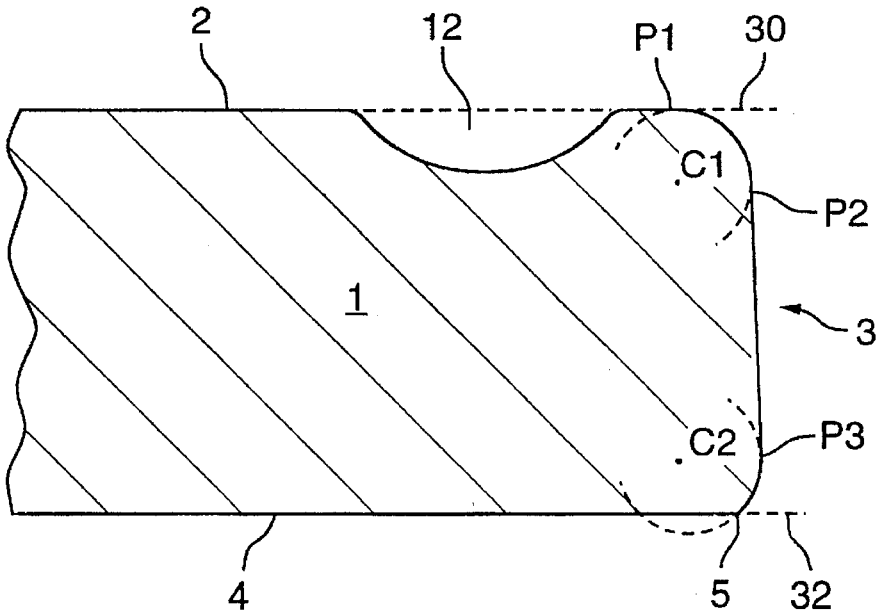
FIG. 2 is an enlarged cross-sectional view of the right hand portion of the tabletop of FIG. 1.

FIGS. 1 and 2 illustrate a circular foil laminated tabletop according to the present invention, the tabletop having an upper surface 2, side surface 3 extending downwardly from upper surface 2, and lower surface 4. The side surface 3 terminates at a lower edge 5 best seen in FIG. 2 (and hidden from view in FIG. 1), where it joins lower surface 4. The upper surface 2 and side surface 3 are laminated with a continuous sheet of foil 6.

FIG. 2 is an enlarged view of the right hand portion of a cross-section of the tabletop of FIG. 1 along section line B—B' in FIG. 1.

FIG. 2 shows dotted line 30 as representing an upper flat plane in which the upper surface 2 substantially lies. FIG. 2 also shows dotted line 32 as representing a lower flat plane in which lower surface 4 lies with the upper plane parallel to the lower plane.

The tabletop of FIG. 1 is provided with a spill groove 12 below the upper plane in which the upper surface 2 lies. The spill groove 12 runs about the circumference of the tabletop. Liquid spilled on the upper surface 2 of the tabletop may run into groove 12 from which it may easily be wiped up with a towel, etc. Without a spill groove 12, spilled liquid could more readily spill over sides 3 of the tabletop. The tabletop is also provided with a hole 13 extending down through the center of the tabletop. Hole 13 could be used to retain a pole (not shown) extending upward through the tabletop as for example for an umbrella where the tabletop may be used outdoors.

As is to be appreciated, notwithstanding spill groove 12 and hole 13, substrate 1 shown in FIG. 2 has its upper surface 2 substantially lying in the upper flat plane shown by line 30 and terminating at point P1 where it joins side surface 3 in a smoothly rounded curve C1. The upper plane of the upper surface 2 at point P1 is illustrated as being tangential to curve C1. The smooth transition of upper surface 2 into side surface 3 about point P1 is a "blended transition".

Side surface 3 extends downwardly from point P1 to lower edge 5, where side surface 3 intersects a flat, planar lower surface 4 which is illustrated as lying in a lower plane being parallel to the upper plane in which upper surface 2 substantially lies. Curve C2 describes the curvature of the portion of side surface 3 which ends at lower edge 5, where the side surface 3 intersects lower surface 4. Lower surface 4 is not tangential to curve C2, but rather intersects curve C2 to create angular lower edge 5. Lower edge 5 is referred to as a "non-blended transition" because side surface 3 and lower surface 4 do not blend smoothly into one another, but rather form an angular edge.

As illustrated in FIG. 2, at the point P1 where upper surface 2 and side surface 3 meet there is a blended transition with a smooth continuous surface. In contrast, lower edge 5 is a non-blended transition where side surface 3 and lower surface 4 meet.

FIG. 2 illustrates two additional blended transitions. The straight segment of side surface 3 between points P2 and P3 is orthogonal to the planes in which upper surface 2 and lower surface 4 substantially lie, and is also tangential to curves C1 and C2. Therefore, blended transitions are formed about points P2 and P3. The only non-blended transition in the exemplary substrate illustrated by FIG. 2 is lower edge 5.

Figure 3:
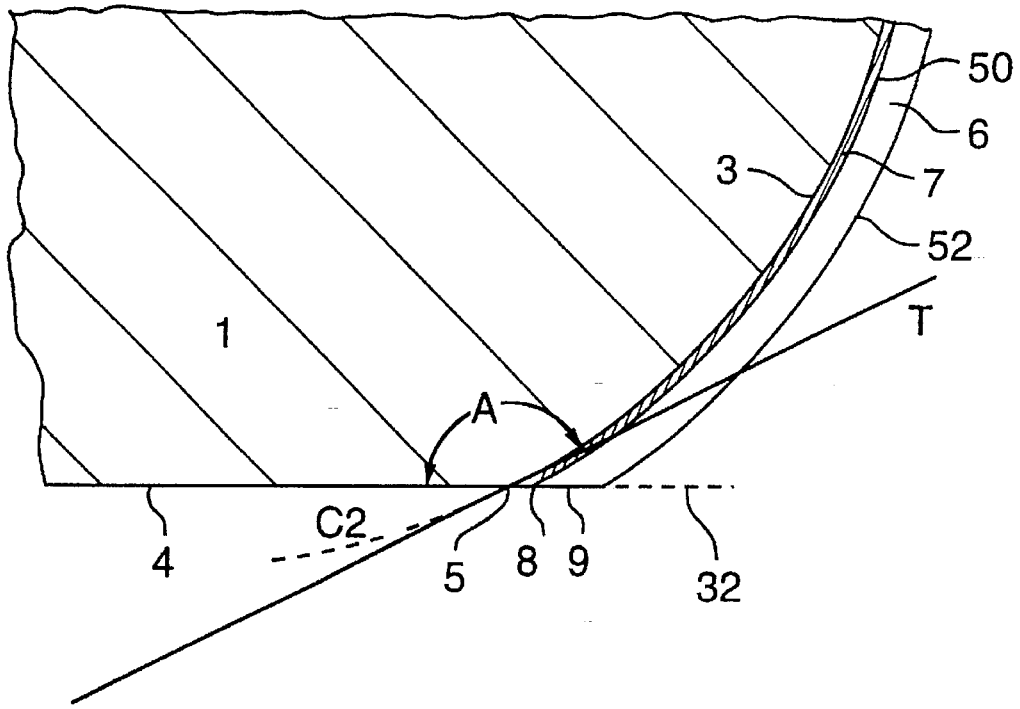
FIG. 3 is an enlarged view of a lower edge portion of FIG. 2.

FIG. 3 illustrates a close-up view of the nonblended lower edge 5 illustrated in FIG. 2, however with the foil layer 6 more clearly shown on the substrate 1. The portion of side surface 3 which ends at lower edge 5 has a curvature described by curve C2. The angle A at which side surface 3 and lower surface 4 meet is the included angle A measured about the lower edge 5 through substrate 1 from the lower plane in which lower surface 4 lies to a tangent T to the side surface 3 at the lower edge 5.

Angle A in FIG. 3 is about 153°. To assist in placing lower edge 5 out of sight, angle A is preferably greater than about 120°, more preferably greater than about 130° or 145° or 155°. Angle A is preferably less than about 170°, more preferably less than about 160° or less than about 150°. Preferably, angle A is in the range of from about 120° to about 160°.

As illustrated in FIG. 3, foil 6 is adhered to substrate 1 by glue layer 7. Foil layer 6 closely follows the contours of side surface 3, following side surface 3 where it curves under to meet lower surface 4. This inward curvature of the foil 6 makes it appear that foil 6 wraps under the substrate.

FIG. 3 shows glue layer 7 ending at glue line 8 which is coincident with the lower plane at lower edge 5. Thus, foil layer 6 is adhered to the substrate 1 only as far as lower edge 5. As shown in FIG. 3, foil 6 has an inner surface 50 adhered to the substrate 1 by glue layer 7, an outer surface 52 forming the outer decorative surface of the tabletop, and an end surface 9 joining the inner and outer surfaces 50 and 52, of foil 6. The end surface 9 of foil layer 6 is in substantially the same plane as lower surface 4. The reference plane provided by the lower surface 4 easily permits trimming of excess foil along the foil edge 9 being an extension of the plane of lower surface 4.

Figure 4:
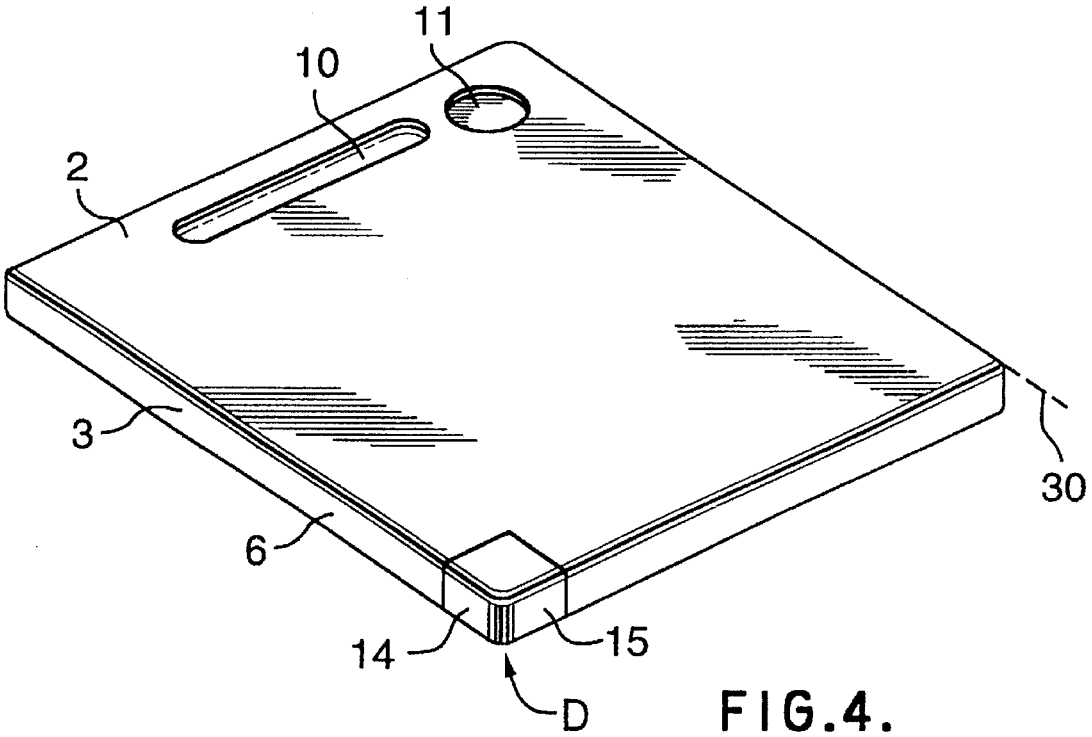
FIG. 4 is a top perspective view of a rectangular foil laminated tabletop according to a second embodiment of the present invention.

FIG. 4 illustrates a foil laminated tabletop having a rectangular plan view. Throughout the drawings, similar reference numerals refer to similar elements. The tabletop is shown as having an upper surface 2 substantially lying in an upper plane represented by line 30 and side surface 3 extending downward from upper surface 2. The upper surface 2 is provided with a groove 10 for retaining writing instruments such as pens and pencils (not shown) and also a circular recess 11 which may preferably function as a cup holder. The upper surface 2 extends below the upper plane in which upper surface 2 substantially lies where groove 10 and circular recess 11 are provided. The tabletop is shown as having a continuous sheet of foil 6 which completely covers the upper surface 2, including the upper surface in the recesses 10 and 11, as well as the side surface 3.

Figure 5:
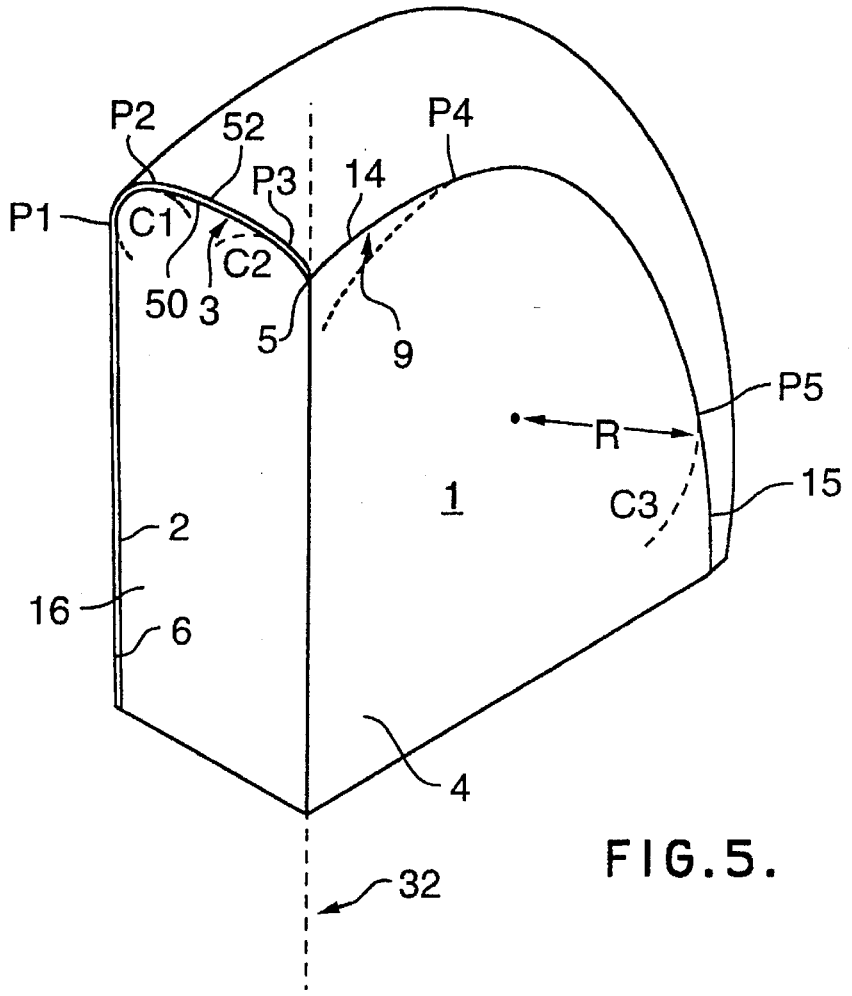
FIG. 5 is an enlarged perspective worm's eye view partly in cross-section of a corner of the tabletop of FIG. 4.

FIG. 5 is an enlarged, cut away worm's eye view, shown partly in cross section, of corner D of the tabletop of FIG. 4 with portions of the side surface about the corner D designated as 14 and 15. As shown in FIG. 5, foil layer 6 terminates at end surface 9 of foil 6 which is coincident with the lower plane represented by line 32 at lower edge 5 at the intersection of side surface 3 and lower surface 4. The glue layer between foil 6 and substrate 1 is too small to be shown. Cross sectional surface 16 has blended transitions at points P1, P2 and P3 and a nonblended transition at lower edge 5. The lower surface 4 of corner D is shown as having, in plan view, a circular curvature C3 with radius R and with blended transitions being formed at points P4 and P5 on the lower surface 4 where side portions 14 and 15 extend tangentially from curve C3.

The radius R of curve C3 should be selected such that creases do not form in the foil 6 at corner D near lower edge 5. The length of radius R practical to prevent creasing of any foil or foil application process is at least partially dependent on the length of the radius of curve C2 and the degree of curvature in side surface. 3. Generally, increasing radius R can assist in avoiding creasing of foil 6 about lower edge 5. Whether or not creasing may occur can be determined by simple experiment.

In tabletops having upper surfaces comprising polygonal shapes other than rectangular, the corners of the upper surface may be rounded in an analogous manner to that shown in FIGS. 4 and 5.

Figure 6:
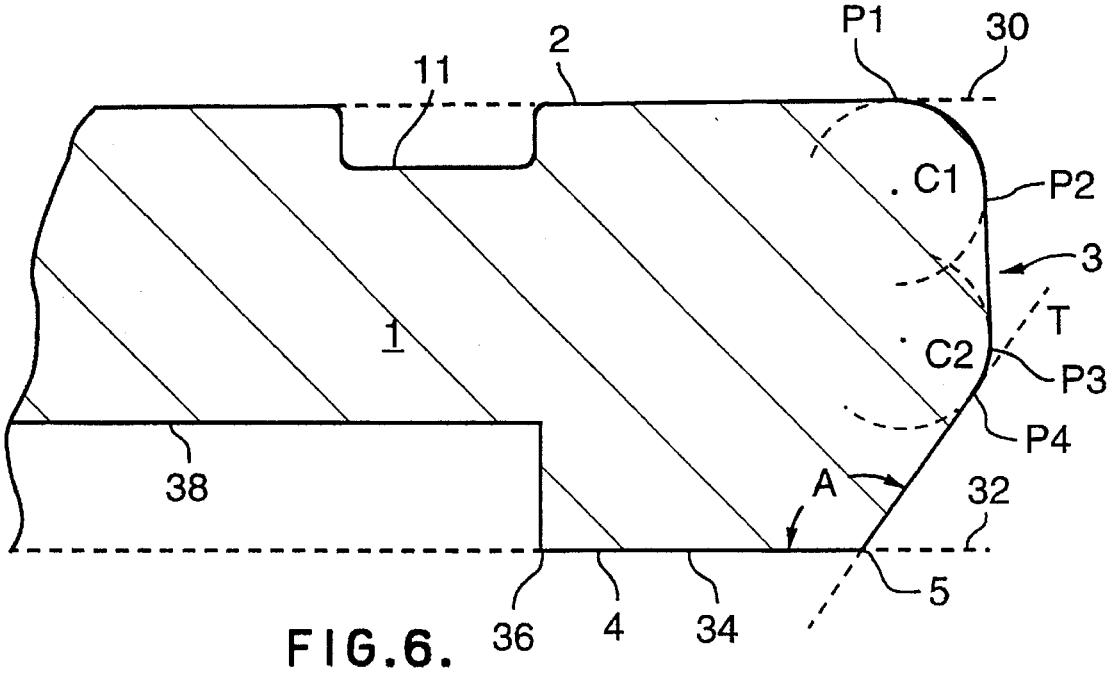
FIGS. 6 and 7 are cross-sectional views similar to FIG. 2 but of third and fourth embodiments of foil laminated tabletops according to the present invention.

FIG. 6 illustrates in cross-section a right hand portion of another substrate 1 according to the present invention preferably for a tabletop. Substrate 1 comprises a substantially flat planar upper surface 2 having a cup retaining recess 11 similar to that shown in FIG. 4, a lower surface 4 and a side surface 3 extending between upper surface 2 and lower surface 4. The substrate 1 is shown in FIG. 6 without the foil layer covering 6 independently shown.

The lower surface 4 is shown as having a border portion 34 which borders on the lower edge 5 about the perimeter of the lower edge 5. The border portion 34 is a flat planar surface extending from lower edge 5 inwardly to its inner edge 36 and preferably as shown in lower plane 32 and parallel to the upper plane 30 in which the upper surface 2 lies. The bottom surface 4 is shown to have inner portion 38 disposed spaced from border portion 34 as may be advantageous for some applications. The planar border 34 about the lower edge provides a guide surface upon which a flat bladed knife can be engaged to be guided to cut excess foil which extends from the lower edge, resulting in a straight, uniform cut line in the plane of the flat planar border portion 34 of the lower surface 4. While the entire lower surface 4 may lie in the same lower plane as shown in FIGS. 1 to 5, this is not necessary and may not be preferred for all applications.

As in FIG. 2, in FIG. 6 upper surface 2 forms a blended transition with side surface 3 about point P1, and side surface 3 extends downward from upper surface 2 to intersect lower surface 4 at lower edge 5. However, unlike FIG. 2, side surface 3 includes a lower portion which is straight where it extends from point P4 to end at lower edge 5. Further, side surface 3 describes a curve C2 approximately midway between upper surface 2 and lower surface 4. The side surface 3 shown in FIG. 4 may be described as being "chamfered" or "bevelled". The lower portion of side surface 3 to some extent appears out of sight.

Angle A shown in FIG. 6 is measured in the same way as shown in FIG. 3, the angle A being the included angle about lower edge 5 through substrate 1 from the lower plane of lower surface 4 to a tangent T to the side surface 3 at the lower edge 5. In FIG. 6, tangent T has the same slope as the lower, straight segment of side surface 3 and therefore angle A can also be defined as the angle about lower edge 5 between lower surface 4 and the lower, straight segment of side surface 3. Angle A is shown as being about 127°.

In the embodiment of FIG. 6 as well as in the embodiments of FIGS. 1 to 5, lower edge 5 where the foil terminates is the sole non-blended transition or edge. All other transitions have been shown to be blended transitions. In addition to lower edge 5 being a nonblended transition, it is within the scope of the invention to have other edges which are non-blended transitions, for example, to have the intersection between the upper surface and side surface be one or more non-blended edges. Foil lamination techniques do not have difficulty in covering such non-blended edges. Blended edges are preferred as more resistant and easier to cover.

Foils suitable for use with the present invention are described in the Background of the Invention although preferred foils are selected from the group comprising polyethylene, polypropylene, polyvinyl chloride and polyester. Preferably, the sheets are from 0.2 to 4.0 mm in thickness, more preferably 0.3 to 1.0 mm, or 0.3 to 0.7 mm.

As a substrate, the present invention may utilize conventionally known substrates although fibreboard, preferably medium density fiberboard, if preferred.

Figure 7:
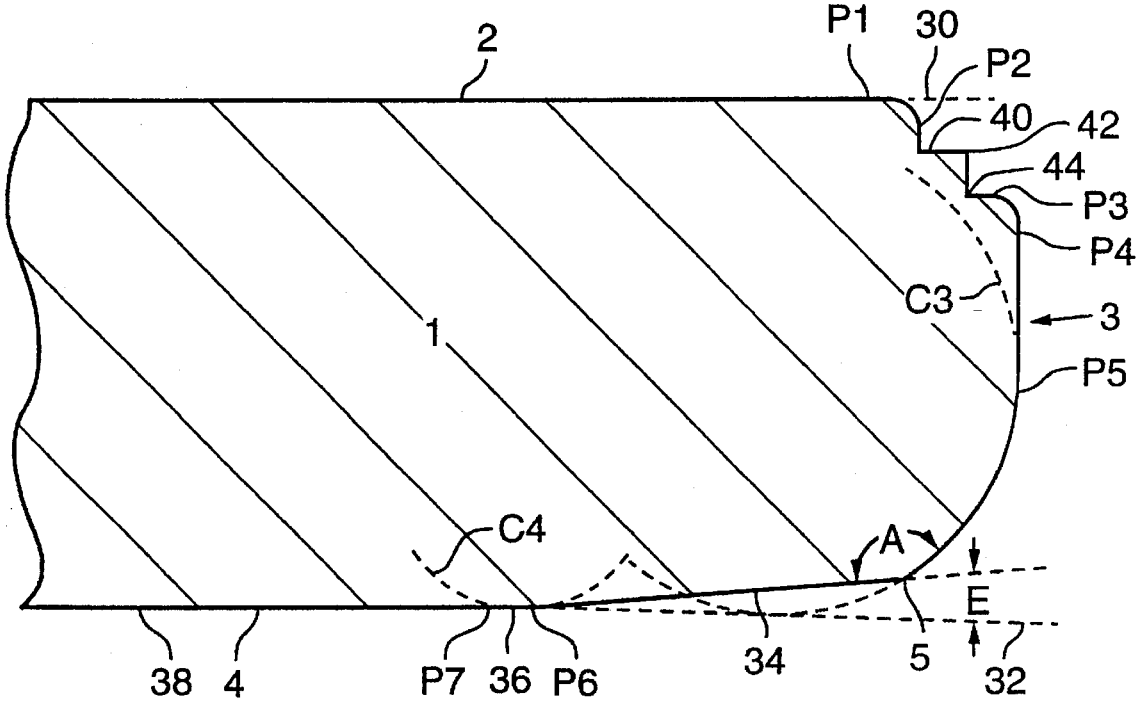

FIG. 7 illustrates in cross-section a right hand portion of another substrate 1 according to the present invention, preferably for a tabletop. Substrate 1 has flat planar upper surface 2, a lower surface 4 and a side surface 3. As is the case in FIG. 6, the bottom surface 4 has a border portion 34 extending from edge 5 to inner edge 36, and an inner portion 38. The border portion 34 is a flat planar surface inclined at an elevation angle E to the parallel lower and upper planes of the bottom inner portion 38 and upper surface 2, respectively. Angle E is preferably equal to or greater than 0 and less than about 20°, more preferably not greater than 15° or 10° or 5°.

The border portion 34 preferably is linear and at a constant angle to the upper plane when viewed at any point along edge 5 in a cross-sectional reference plane normal to both the upper plane and the side surface 3 at such point. It is in such reference plane that the elevation angle E is measured relative the lower plane. Where angle E is greater than 0 and where the perimeter of the top surface describes part of the circle the portion 34 will be a portion of the side wall of a truncated cone and will not be a flat plane. The border portion will be a flat plane where the perimeter of the top surface is straight. FIG. 7 illustrates blended transitions at points P1, P2, P3, P4, P5, P6 and P7 and non-blended transitions at edges indicated as 40, 42, 44 and lower edge 5. Lower edge 5 is where the foil terminates. The substrate 1 of FIG. 7 could be made by making blended transitions of circle C3 to side surface 3 and bottom surface 4 and then machining border portion 34. Providing border portion 34 at angle E to the lower plane further assists in reducing a user of a tabletop from feeling at edge 5 the end of the foil.

The configurations of the substrate is to be selected such that in forming in the press, the foil presents a smooth surface without unacceptable folds or creases developing. If for example in the embodiments illustrated in each of FIGS. 2, 5 and 6, the length of the perimeter of the foil at edge 5 is too much smaller than the length of the perimeter of the foil at P3, then folds or creases may result during pressure forming. The curvature of the substrate as seen in plan view will have a bearing on whether difficulties may arise regarding such folding.

With any given configuration of substrate, foil, and process of pressure forming, simple experimentation can be carried out to determine whether unacceptable folding may occur. Factors which will affect the likelihood of folding include the size of the radius of curve C2 as seen in FIGS. 2 and 5, the size of the included angle A, the length of the curvature between edge 5 and point P3 in FIGS. 2 and 5, the length of the straight portion between edge 5 and point P4 in FIG. 6, and the length of the curvature and radius R of plan curve C3 in FIG. 5.

Figure 8:
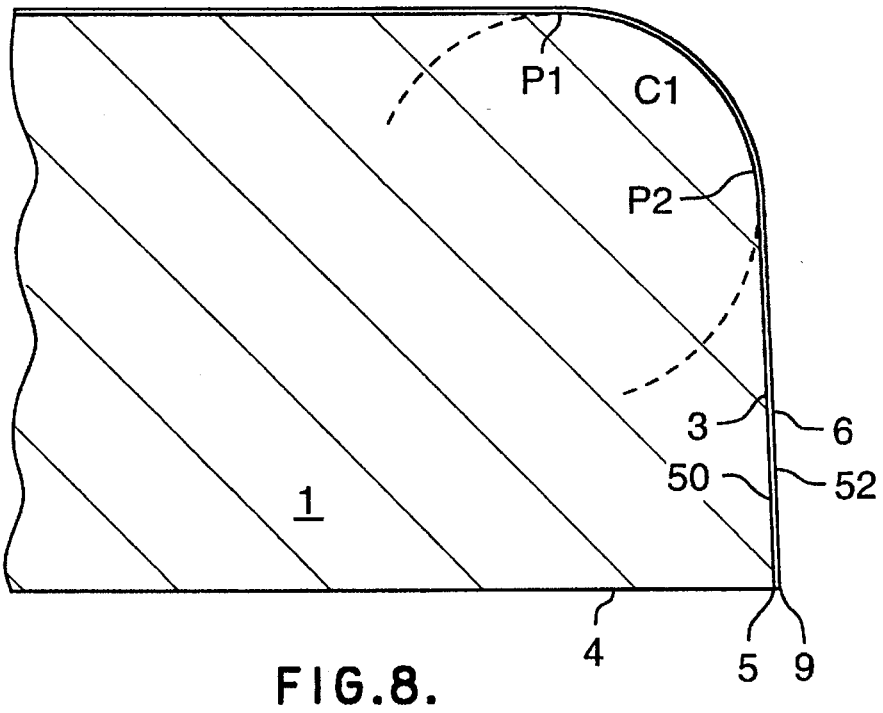
FIG. 8 is a cross-sectional view similar to FIG. 2 but of a right hand portion of a foil laminated tabletop according to the prior art.

FIG. 8 illustrates a cross sectional view of the right hand portion of a foil laminated tabletop according to the prior art. A continuous sheet of foil 6 extends over upper surface 2 and down over side surface 3, the foil 6 being adhered to substrate 1 by a layer of glue which is too small to be shown. Upper surface 2 joins side surface 3 at point P1 in a blended transition, the curvature of side surface 3 being defined by curve C1. There is also a blended transition at point P2 on the side surface 3. Side surface 3 intersects lower surface 4 at edge 5 with an angle of about 90°. The glue layer 7 terminates and the end surface 9 of foil 6 lies in the same lower plane as lower surface 4.

Although the invention has been described in connection with certain preferred embodiments, it is not intended that it be limited thereto. Rather, it is intended that the invention cover all alternate embodiments as may be within the scope of the following claims.

The embodiments of the invention in which an exclusive property or privilege is claimed are defined as follows:

1. A method for manufacturing a foil laminated tabletop, comprising:

forming a tabletop from a solid substrate, said substrate comprising an upper surface, a lower surface and a side surface;

the side surface extending downwardly from the upper surface to the lower surface to join the upper and lower surfaces;

the lower surface lying in a flat lower plane, the upper surface being substantially parallel to the lower plane;

the side surface and the lower surface intersecting at an angular lower edge;

an included angle measured about the lower edge through the substrate from the lower plane to a tangent to the side surface at the lower edge being at least about 120 degrees;

laying a sheet of thin plastic foil over the upper surface of the tabletop, the plastic foil having an inner surface and an outer surface opposite the inner surface;

loading the substrate covered with the plastic foil into a membrane form press, the press having a pressure chamber in which pressure is applied to the substrate and the plastic foil;

applying pressure to the substrate and the foil in the pressure chamber of the membrane form press, the inner surface of the plastic foil becoming directly adhered to the substrate, the plastic foil extending as a smooth, free of joints, continuous sheet over the entirety of the upper surface and down over the side surface to the lower edge to closely adopt profiles of the upper and side surfaces with excess foil extending from the side surface of the tabletop at the lower edge and said excess foil not adhered to the substrate;

removing the foil laminated tabletop from the membrane form press; and trimming the excess plastic foil from the tabletop along the lower edge to form an end surface of the foil joining the inner and outer surfaces of the foil and lying substantially in the lower plane.

2. The method of claim 1, wherein the inner surface of the plastic foil is adhered to the substrate by a thin layer of glue applied between the substrate and the inner surface of the foil.

3. The method of claim 1, wherein the inner surface of the plastic foil is adhered to the substrate by a thin layer of heat activated glue applied between the substrate and the inner surface of the foil, and wherein the substrate and foil are heated in the membrane form press to activate the glue and thereby adhere the inner surface of the foil to the substrate.

4. The method of claim 1, wherein the trimming is performed by cutting through the foil along the lower edge with a cutting blade of a cutting instrument, the blade being positioned substantially parallel to the lower plane while cutting the foil.

5. The method of claim 1, wherein the plastic foil is trimmed so that the end surface lies in the lower plane.

6. The method of claim 1, wherein the tabletop is formed with the side surface having a lower portion proximate the lower edge and ending at the lower edge, the lower portion of the side surface defining a curved line in a plane perpendicular to the lower surface.

7. The method of claim 1, wherein the tabletop is formed with the side surface having a lower portion proximate the lower edge and ending at the lower edge, the lower portion of the side surface defining a straight line in a plane perpendicular to the lower surface.

8. The method of claim 1, wherein the tabletop is formed so that the angle measured about the lower edge is from about 120 degrees to about 170 degrees.

9. The method of claim 1, wherein the tabletop is formed so that the angle measured about the lower edge is less than about 160°.

10. The method of claim 1, wherein the tabletop is formed so that the angle measured about the lower edge is greater than about 145° and less than about 170°.

11. The method of claim 1, wherein the tabletop is formed with the upper surface substantially lying in an upper plane, a functional retaining recess being formed in the upper surface and situated below the upper plane.

12. The method of claim 11, wherein the functional retaining recess is selected from the group comprising:

a groove to retain writing instruments;

a spill retaining groove;

a cup retaining recess;

a recess for retaining a napkin dispenser;

a recess for retaining condiment dispensers; and a hole through the tabletop substantially centered in the upper surface to retain a pole which supports a sun shade.

13. The method of claim 1, wherein the plastic foil comprises a thin sheet of plastic material, the plastic material being selected from the group comprising polyethylene, polypropylene, polyvinyl chloride and polyester; the sheet being from 0.2 to 0.7 mm in thickness.

14. The method of claim 1, wherein the tabletop is formed with the upper surface having a polygonal shape with a plurality of corners, each of said corners being rounded in plan view and having a radius of curvature sufficient to prevent the plastic foil from creasing proximate the lower edge.

15. A method as claimed in claim 1, wherein the substrate comprises medium density fibreboard.

16. A method for manufacturing a foil laminated tabletop, comprising:

forming a tabletop from a solid substrate, said substrate comprising an upper surface, a lower surface and a side surface;

the side surface extending downwardly from the upper surface to the lower surface to join the upper and lower surfaces;

the side surface and the lower surface intersecting at an angular lower edge;

the upper surface lying in a flat upper plane;

the lower surface having a border portion extending inwardly from the lower edge;

in a cross-sectional reference plane normal to the side surface and normal to the upper plane, the border portion being linear and disposed at an elevation angle equal to or greater than 0° and less than about 20° relative to the upper plane;

an included angle measured about the lower edge through the substrate in said reference plane at any point along the lower edge from the border portion to a tangent to the side surface at the lower edge being at least about 120 degrees;

laying a sheet of thin plastic foil over the upper surface of the substrate, the plastic foil having an inner surface and an outer surface opposite the inner surface;

loading the substrate covered with the plastic foil into a membrane form press, the press having a pressure chamber in which pressure is applied to the substrate and the plastic foil;

applying pressure to the substrate and the foil in the pressure chamber of the membrane form press, the inner surface of the plastic foil becoming directly adhered to the substrate, the plastic foil extending as a smooth, free of joints, continuous sheet over the entirety of the upper surface and down over the side surface to the lower edge to closely adopt profiles of the upper and side surfaces with excess foil extending from the side surface of the tabletop at the lower edge and said excess foil not adhered to the substrate;

removing the foil laminated tabletop from the membrane form press; and trimming the excess plastic foil from the tabletop along the lower edge to form an end surface of the foil joining the inner and outer surfaces of the foil and being substantially collinear with the border portion in the reference plane.

17. The method of claim 16, wherein the inner surface of the plastic foil is adhered to the substrate by a thin layer of glue applied between the substrate and the inner surface of the foil.

18. The method of claim 16, wherein the inner surface of the plastic foil is adhered to the substrate by a thin layer of heat activated glue applied between the substrate and the inner surface of the foil, and wherein the substrate and foil are heated in the membrane form press to activate the glue and thereby adhere the inner surface of the foil to the substrate.

19. The method of claim 16, wherein the trimming is performed by cutting through the foil along the lower edge with a cutting blade of a cutting instrument, the blade being positioned substantially parallel to the border portion in the reference plane while cutting the foil.

20. The method of claim 16, wherein the plastic foil is trimmed so that the end surface is collinear with the border portion in the reference plane.

21. The method of claim 16, wherein the tabletop is formed so that the included angle is less than about 170° and the elevation angle is less than about 10°.

22. The method of claim 16, wherein the tabletop is formed so that the included angle is less than about 160° and the elevation angle is less than about 10°.

* * * * *